US006651293B2

(12) United States Patent
Kishi

(10) Patent No.: US 6,651,293 B2
(45) Date of Patent: Nov. 25, 2003

(54) APPARATUS FOR PROCESSING A PAVEMENT SURFACE UTILIZING PRESSURIZED WATER

(75) Inventor: Yukio Kishi, Saitama (JP)

(73) Assignee: Sakai Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/778,902

(22) Filed: Feb. 8, 2001

(65) Prior Publication Data

US 2001/0012475 A1 Aug. 9, 2001

(30) Foreign Application Priority Data

Feb. 9, 2000 (JP) ..... 2000-031538
Aug. 30, 2000 (JP) ..... 2000-260026

(51) Int. Cl.[7] ..... A47L 9/02
(52) U.S. Cl. ..... 15/320; 15/322
(58) Field of Search ..... 15/320, 322

(56) References Cited

U.S. PATENT DOCUMENTS

| | | | | | |
|---|---|---|---|---|---|
| 1,168,175 | A | * | 1/1916 | Deardorf | 15/353 |
| 3,959,010 | A | * | 5/1976 | Thompson et al. | 15/320 |
| 4,069,540 | A | * | 1/1978 | Zamboni | 15/320 |
| 4,168,562 | A | * | 9/1979 | Maasberg | 15/320 |
| 4,219,155 | A | * | 8/1980 | Goerss | 15/320 |
| 4,586,213 | A | * | 5/1986 | Bricher et al. | 15/320 |
| 4,756,048 | A | * | 7/1988 | Kauffeldt et al. | 15/320 |
| 5,460,657 | A | * | 10/1995 | Ally | 15/320 |
| 6,189,177 | B1 | * | 2/2001 | Shook et al. | 15/320 |
| 6,381,801 | B1 | * | 5/2002 | Clemons, Sr. | 15/320 |

* cited by examiner

*Primary Examiner*—Theresa T. Snider
(74) *Attorney, Agent, or Firm*—Sughrue Mion, PLLC

(57) ABSTRACT

Cavitation is produced through injection of pressurized water from an injection outlet of an injection nozzle 17*a* toward the pavement surface in liquid of a liquid storage part $T_1$ formed on the pavement surface. A clogging object in a cavity of a pavement is isolated by impactive force of the cavitation, and the isolated clogging object is removed by suction with water.

14 Claims, 9 Drawing Sheets

APPARATUS FOR PROCESSING A PAVEMENT SURFACE UTILIZING PRESSURIZED WATER

FIELD OF THE INVENTION

The present invention relates to a method and apparatus for processing a pavement surface. The method and apparatus are suitable for, e.g., removing soil, sand and dust clogging a cavity of drainage pavement, chipping a surface of drainage pavement, and chipping a road surface at increasing thickness of the road surface.

BACKGROUND OF THE INVENTION

First, a drainage pavement is described referring to FIG. 10. Drainage pavement a is formed by arranging a subgrade b, a base course c, a binder course d, and a surface course having a cavity e capable of passing water. The drainage pavement a guides to a gutter (not shown) and drains rainwater flowing into the cavity e of the surface course f. Therefore, the drainage pavement a has a function of reducing factors interfering with the safety of traveling such as smoking phenomenon wherein water is sprayed by tires of a traveling vehicle and obstructs view of driver, hydroplaning phenomenon, and so on. The cavity e of the surface course f has the ability to absorb noise, thus the drainage pavement a in addition has a function of reducing noise produced by tires of a vehicle traveling. Further, the binder course d part of the drainage pavement a is impervious to water for protection of the base course c.

In regard to the drainage pavement a, soil, sand, and dust, for example, may clog the cavity e of the surface course f due to the traveling of a vehicle and winds and, therefore, there is degradation in the drainage of pavement a in a relatively short time. Therefore, conventionally, an injection nozzle injects pressurized water to a pavement surface, a clogging object in the cavity e of the pavement a is isolated by spray pressure of the pressurized water and removed by suction with the water to clean the pavement surface in order to recover the function of the pavement surface.

When soil, sand, and dust clog significantly, it is difficult to remove all of the soil, sand and dust. Therefore, a road surface milling apparatus removes a surface course (aggregate coupled by asphalt) and the road surface is repaved with new material.

Chipping a concrete road surface for increasing a thickness of the road surface of, for example, a bridge, and removing tire rubber adhered to a road surface of an airport runway, are now described. An injection nozzle injects ultra-high pressurized water to a pavement surface and the impactive force thereof chips only the upper layer of the surface course f.

However, by injecting pressurized water, an injection nozzle just injects pressurized water to a pavement surface. Therefore, the effect of removing a clogging object in the cavity of the pavement is not sufficiently produced.

Moreover, when a road surface milling apparatus removes a surface course, a carbide chip crushes and mills the surface course. Therefore, aggregate (rock) cracks are produced and the surface course material cannot be recycled after milling.

Additionally, when ultra-high pressurized water chips a road surface, ultra-high pressurized water is usually injected at high pressure such as over 98000 kPa from an injection nozzle into the air. Therefore, aggregate, pebble, and the like are peeled from the road surface and they fly into the air. As a consequence, a problem arises from a safety standpoint and noise during chipping is increased.

The present invention is made for solving these problems. The object of the first aspect of the present invention is to provide a method and apparatus for processing a pavement surface which can remove clogging object in the cavity of the pavement with efficiency.

The object of the second aspect of the present invention is to provide a method and apparatus for processing a pavement surface. A surface course can be recycled through the use of the method and apparatus. The method and apparatus can prevent aggregate, pebble, and the like on a road surface from flying to ensure safety, moreover, can reduce noise at chipping.

SUMMARY OF THE INVENTION

To achieve these objects, the present invention provides a method for processing a pavement surface wherein cavitation is produced through injection of pressurized water toward the pavement surface in liquid of a liquid storage part formed on the pavement surface, a clogging object in a cavity of a pavement is isolated by impactive force of the cavitation, and the isolated clogging object is removed by suction with water.

In the method for processing a pavement surface, atmospheric pressure in said liquid storage part is lower than atmospheric pressure of the outside, preferably.

The present invention provides an apparatus for processing a pavement surface. This apparatus has an injection means, a suction means, and a liquid storage part. The injection means injects pressurized water toward the pavement surface. The suction means removes a clogging object by suction with water wherein the clogging object is isolated in a cavity of a pavement by injection of pressurized water of the injection means. The liquid storage part surrounds an injection outlet of the injection means and allowing to store liquid with the liquid storage part contacting on the pavement surface in such a manner that the injection outlet positions in the liquid.

In the apparatus for processing a pavement surface, atmospheric pressure in said liquid storage part is lower than atmospheric pressure of the outside, preferably.

The present invention provides a method for processing a pavement surface wherein cavitation is produced through injection of pressurized water toward the pavement surface in liquid of a liquid storage part formed on the pavement surface, the pavement surface is chipped by impactive force of the cavitation, and a peeled object after chipping is removed by suction with water.

The present invention provides an apparatus for processing a pavement surface. This apparatus has an injection means, a suction means, and a liquid storage part. The injection means injects pressurized water toward the pavement surface and chipping the pavement surface. The suction means removes a peeled object after chipping by suction with water.

The liquid storage part surrounds an injection outlet of the injection means and allowing to store liquid with the liquid store part contracting on the pavement surface in such a manner that the injection outlet positions in the liquid.

DESCRIPTION OF THE PREFERRED EMBODIMENTS

Figure 10:
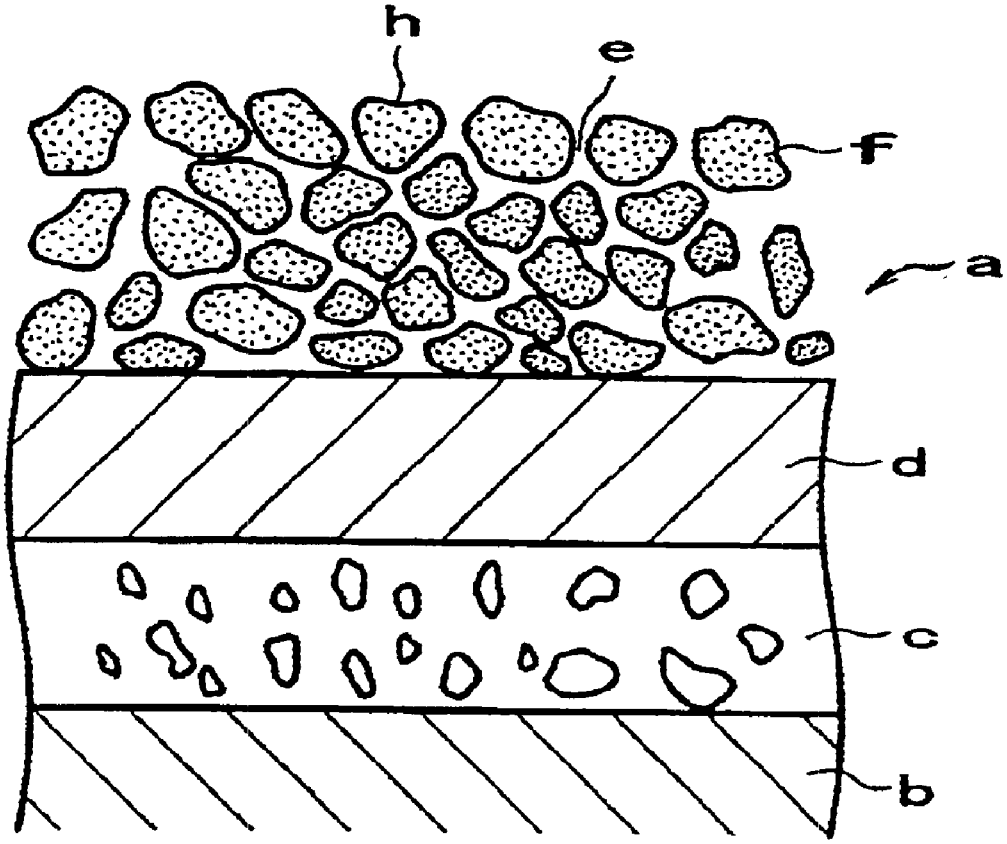
FIG. 10 is a schematic section for describing a drainage pavement.

The first and second embodiments describe a drainage pavement as an example of a pavement. The structure of the drainage pavement is identical to the described structure of the conventional embodiment (see FIG. 10) and will be described with same marks.

First, referring to FIGS. 1–4, the first embodiment is described. The apparatus for processing a pavement surface removes a clogging object in the cavity e of a pavement a, and comprises, a case 10 to be attached to a towed vehicle such as a truck or the like via a movable arm.

Front and rear side plates 11*a* and 11*b* in the direction of travel and left-and-right end plates 12*a* and 12*b*, which couple both edges of the side plates 11*a* and 11*b*, form the case 10. Therefore, the case 10 is a long substantially rectangular parallelepiped and the length thereof is in the width direction of the vehicle. The top and the bottom of the case 10 are open.

The left-and-right end plates 12*a* and 12*b* have both ends roll axes 14 of traveling rolls 13*a*, 13*b*, 21*a* and 21*b*, supported. The traveling rolls 13*a* and 13*b* are placed in the fore-and-aft direction of travel. The traveling rolls 21*a* and 21*b* are centered to maintain a distance in the fore-and-aft direction of travel. Each outer periphery of the traveling rolls 13*a*, 13*b*, 21*a* and 21*b* has an elastic body G made of rubber In the case 10, water passing tubes 15*a* and 15*b*, which extend in the direction of the length of the case 10, are placed keeping a distance in the direction of travel. The water passing tube 15*a* is fixed to a top 26 placed upward between the traveling roll 13*a* and the traveling roll 21*a*. The lower side part of the water passing tube 15*a* has an injection nozzle (injection means) 17*a*, which injects high pressurized water toward a pavement surface h in a slanting rear direction, the injection nozzle provided in the axial direction of the water passing tube 15*a* at substantially regular intervals. When the injection nozzle 17*a* is provided in the axial direction at substantially regular intervals, it is not necessarily arranged in a straight line.

The top 26 is extended in the direction of the length of the case 10 and both edges thereof stretch to the end plates 12*a* and 12*b*. The front side part is extended toward the front and stretches to the front side plate 11*a*. A suction part 32 of a suction duct 18 is inserted between the injection nozzle 17*a* of the top 26 and the traveling roll 13*a*.

The suction part 32 is extended in the direction of the length of the case 10 and both edges thereof stretch to the end plates 12*a* and 12*b*. The suction part 32 has a lower side plate 18*a*, an upper side plate 18*b*, and a coupling plate 18*c*. The lower side plate 18*a* is extended toward the pavement surface h in a slanting rear direction and comes into contact with the elastic body G on the outer periphery of the traveling roll 13*a*. The upper side plate 18*b* is placed in parallel with the lower side plate 18*a* on the rear side of the lower side plate 18*a*. The coupling plate 18*c* couples each upper edge of the lower side plate 18*a* and the upper side plate 18*b*, and is connected to the suction duct 18. The upper part of the upper side plate 18*b* has a hole 18*d* formed thereon and the hole makes fluid levels of a liquid storage part $T_1$ at front and rear of the upper side plate 18*b* the same.

The water passing tube 15*b* is attached to the rear side 11*b* via a bracket 16*b*. The lower part of the water passing tube 15*b* has a plurality of injection nozzles 17*b*, which inject high pressurized water toward a pavement surface h in a slanting forward direction, provided in the axial direction of the water passing tube 15*b* at substantially regular intervals. A suction duct 19 is placed between the injection nozzle 17*b* and the traveling roll 21*b* in the direction of the length of the case 10. The suction duct 19 is extended toward the pavement surface h in a slanting rear direction and the tip thereof is a suction opening 19*a*.

The rear side part of the above-described top 26 comes into contact with the front side wall of the suction duct 19. A cover 29 extends from the tip of the suction duct 19 to the traveling roll 13*b*. The cover 29 has a horizontal part 29*a*, an upper side slanting part 29*b*, an intersecting part 29*c*, and a lower side slanting part 29*d*. The horizontal part 29*a* is extended from the tip of the suction duct 19 toward the rear in a horizontal direction. The upper side slanting part 29*b* is extended from the tip of the horizontal part 29*a* in the injection direction of the injection nozzle 17*b*. The intersecting part 29*c* is extended from the tip of the upper side slanting part 29*b* in a direction intersecting the injection direction of the injection nozzle 17*b*. The lower side slanting part 29*d* is extended from the tip of the intersecting part 29*c* in the injection direction of the injection nozzle 17*b* in parallel with the upper side slanting part 29*b*. The intersecting part 29*c* has passing holes 29*e* formed therein. The high pressurized water injected from the injection nozzle 17*b* passes through the passing holes 29*e* and the passing holes 29*e* are associated with the number of injection nozzles 17*b*.

The tip of the lower side slanting part 29*d* and the tip of the suction duct 19 independently have a seal rubber 38 extended in a vertical direction attached by screws or the like. The tip of the seal rubber 38 comes into contact with the pavement surface h.

A suction duct 20 (suction means) is placed in the direction of the length of the case 10 and inserted between the traveling roll 21*a* and the traveling roll 21*b* of the top 26. The suction duct 20 is extended in a vertical direction and the tip thereof is a suction opening 20*a*. The front side wall of the suction duct 20 comes into contact with the elastic body G on the outer periphery of the traveling roll 21*a*, and the rear wall part of the suction duct 20 comes into contact with the elastic body G on the outer periphery of the traveling roll 21*b*.

Moreover, a side cover 22*a* is placed between each roll end face of the traveling rolls 13*a*, 13*b*, 21*a* and 21*b* and the end plate 12*a*. A side cover 22*b* is placed between each roll end face of the traveling rolls 13*a*, 13*b*, 21*a* and 21*b* and the end plate 12*b*.

The side covers 22*a* and 22*b* independently have a plate body part 23 and a round bar part 24. The round bar part 24 is fixed to the lower part of the body part 23 in the direction of travel by welding or the like and comes into contact with the pavement surface h.

A long hole 23*a* extended vertically is formed at the position of the body part 23 corresponding to both end roll axes 14 of the traveling rolls 13*a*, 13*b*, 21*a* and 21*b*. The long hole 23*a* has both end roll axes 14 of the traveling rolls 13*a*, 13*b*, 21*a* and 21*b* inserted therein. Therefore, the side covers 22*a* and 22*b* can move vertically, and when traveling on the uneven pavement surface h, the round bar part 24 follows the uneven pavement surface h.

Moreover, there is a helical tension spring 25 between the side cover 22*a* and the end plate 12*a*. The upper edge of the helical tension spring 25 is attached to the body part 23 of the side cover 22*a* and the lower edge of the helical tension spring 25 is attached to the end plate 12*a*.

Similarly, there is a helical tension spring 25 between the side cover 22*b* and the end plate 12*b*. The upper edge of the helical tension spring 25 is attached to the body part 23 of the side cover 22*b* and the lower edge of the helical tension spring 25 is attached to the end plate 12*b*. Therefore, the side covers 22*a* and 22*b* are urged toward the pavement surface h to bring the round bar part 24 into further intimate contact with the pavement surface h. The spring constant of the helical tension spring 25 is adjusted and the contact pressure of the round bar part 24 to the pavement surface h can be adjusted.

In the present embodiment, the traveling roll 13*a*, the lower side plate 18*a* of the suction part 32, the top 26, the traveling roll 21*a*, the front side wall of the suction duct 20, and the side covers 22*a* and 22*b* form the liquid storage part $T_1$ allowing to store water therein. The cover 29, each the seal rubber 38, and the side covers 22*a* and 22*b* place the suction opening 19*a* of the suction duct 19 at the substantial sealed space $T_2$. The front and rear sides walls of the suction duct 20 and the traveling rolls 21*a* and 21*b* place the suction opening 19*a* of the suction duct 19 at the substantial sealed space $T_3$.

The top 26 has a water feed part 27 feeding water into the liquid storage part $T_1$. The water feed part 27 feeds water into the liquid storage part $T_1$ and an injection outlet of the injection nozzle 17*a* is placed in water. In the present embodiment, the water feed part 27 feeds water into the liquid storage part $T_1$ after air in the liquid storage part $T_1$ is sucked by the suction duct 18, thereby creating a negative pressure in the liquid storage part $T_1$. After there is negative pressure in the liquid storage part $T_1$, the water feed part 27 feeds water because a spill of water is prevented upon commencing work. However, the sequence is not limited to this.

An amount of feed water is adjusted in accordance with suction power of the suction duct 18 so that the injection outlet of the injection nozzle 17*a* is always placed in water after air in the liquid storage part $T_1$ is carried by the suction duct 18.

The lower side slanting part 29*d* of the cover 29 has the roll surface of the traveling roll 13*b* placed in its proximity. Thus, the roll surface of the traveling roll 13*b* is placed in the proximity to the lower side slanting part 29*d*. Therefore, when the seal rubber 38 on the tip of the lower side slanting part 29*d* is worn and a clearance between the seal rubber 38 and the pavement surface h is increased, an amount of air entered from the clearance can be controlled and steep deterioration in hermeticity of the substantial sealed space $T_3$ is prevented.

Operation of the apparatus for processing a pavement surface, which has the above-described configuration, will now be described. First, the water feed part 27 feeds water into the liquid storage part $T_1$ and the injection outlet of the injection nozzle 17*a* is placed in water, after air in the liquid storage part $T_1$ is sucked by the suction duct 18, thereby creating negative pressure in the liquid storage part $T_1$. In this state, the apparatus is towed by a vehicle such as a truck on the road of the drainage pavement a and the injection nozzles 17*a* and 17*b* inject high pressurized water toward a pavement surface h at the same time.

At this time, the injection outlet of the injection nozzle 17*a* is placed in water. Therefore, the injection nozzle 17*a* injects high pressurized water toward the pavement surface h. Cavitation is produced between water in the liquid storage part $T_1$ and high pressurized water, and a clogging object such as soil, sand, dust or the like in the cavity e of the pavement a is isolated by impactive force of the cavitation and floats to the pavement surface h. The liquid mixture of the floated clogging object and water is removed by suction from the suction opening 20*a* of the suction duct 20.

High pressurized water injected from the injection nozzle 17*b* will now be described. Suction of outside air by the force of suction of the suction duct 19 from the hole 29*e* provided on the intersecting part 29*c* of the cover 29 to the substantial sealed space $T_2$ produces a flow of air along the high pressurized water. Therefore, a kind of curtain films is formed along the high pressurized water and the high pressurized water is prevented from flying to its surroundings. The high pressurized water is sprayed toward a pavement surface h in a state in which an impactive force between the high pressurized water and the pavement surface h is maintained.

The injection nozzle 17*b* injects high pressurized water. Therefore, the liquid mixture of the floated clogging object and water floats to the pavement surface h facing the substantial sealed space $T_2$ and the liquid mixture is removed by suction from the suction opening 19*a* of the suction duct 19. The suction openings 19*a* and 20*a* of the suction ducts 19 and 20 are placed at the substantial sealed spaces $T_2$ and $T_3$, respectively. Therefore, there is negative pressure in the substantial sealed spaces $T_2$ and $T_3$ by suction of the suction ducts 19 and 20. As a consequence, floating of the liquid mixture of the floated clogging object and water to the pavement surface h is furthered.

As is clear from the descriptions above, in the present embodiment, high pressurized water is injected toward a pavement surface h from the injection outlet of the injection nozzle 17*a* in water in the liquid storage part $T_1$. Cavitation is produced, and a clogging object such as soil, sand, dust or the like clogging the cavity e of the pavement a is isolated by impactive force of the cavitation, and then the isolated clogging object, as well as water injected by nozzle 17*a* is removed by suction. Therefore, as compared with case the in which high pressurized water is just injected toward the pavement surface h, the effect of removing a clogging object in the pavement a can by far be improved.

There is negative pressure in the liquid storage part $T_1$, therefore, water in the liquid storage part $T_1$ can be resistant to leaks to the outside, and production of cavitation at injecting high pressurized water in water is furthered.

Moreover, the side covers 22*a* and 22*b* seal edges of the case 10 in the direction of the length of the case 10, and they are placed to be able to move vertically. While traveling on the uneven pavement surface h, the round bar part 24 follows the uneven pavement surface. Further, the helical tension spring 25 applies a force to the side covers 22*a* and 22*b* toward the pavement surface h to bring the round bar part 24 into further intimate contact with the pavement surface h. Therefore, air can be prevented from accidentally entering from the round bar part 24 and the pavement surface h into the substantial sealed spaces $T_2$ and $T_3$, and leaks of water in the liquid storage part $T_1$ to the outside can be controlled.

The water lying means will now be described, which is provided for further improving sealing ability of both sides of the suction duct 20.

The water lying means makes water intervene forcefully between the round bar parts 24 of the side covers 22*a* and 22*b* and the pavement surface h. The side covers 22*a* and 22*b* are placed on the right and left sides of the suction duct 20, respectively. When a clearance between the round bar part 24 and the pavement surface h is produced, the clearance makes water intervene in the clearance, wherein the water has a higher resistance than air. Therefore, air is prevented from being taken into the substantial sealed space $T_3$ and the hermeticity of the substantial sealed space $T_3$ is improved further. As a consequence, suction performance of the suction duct 20 is enhanced further.

Figure 1:
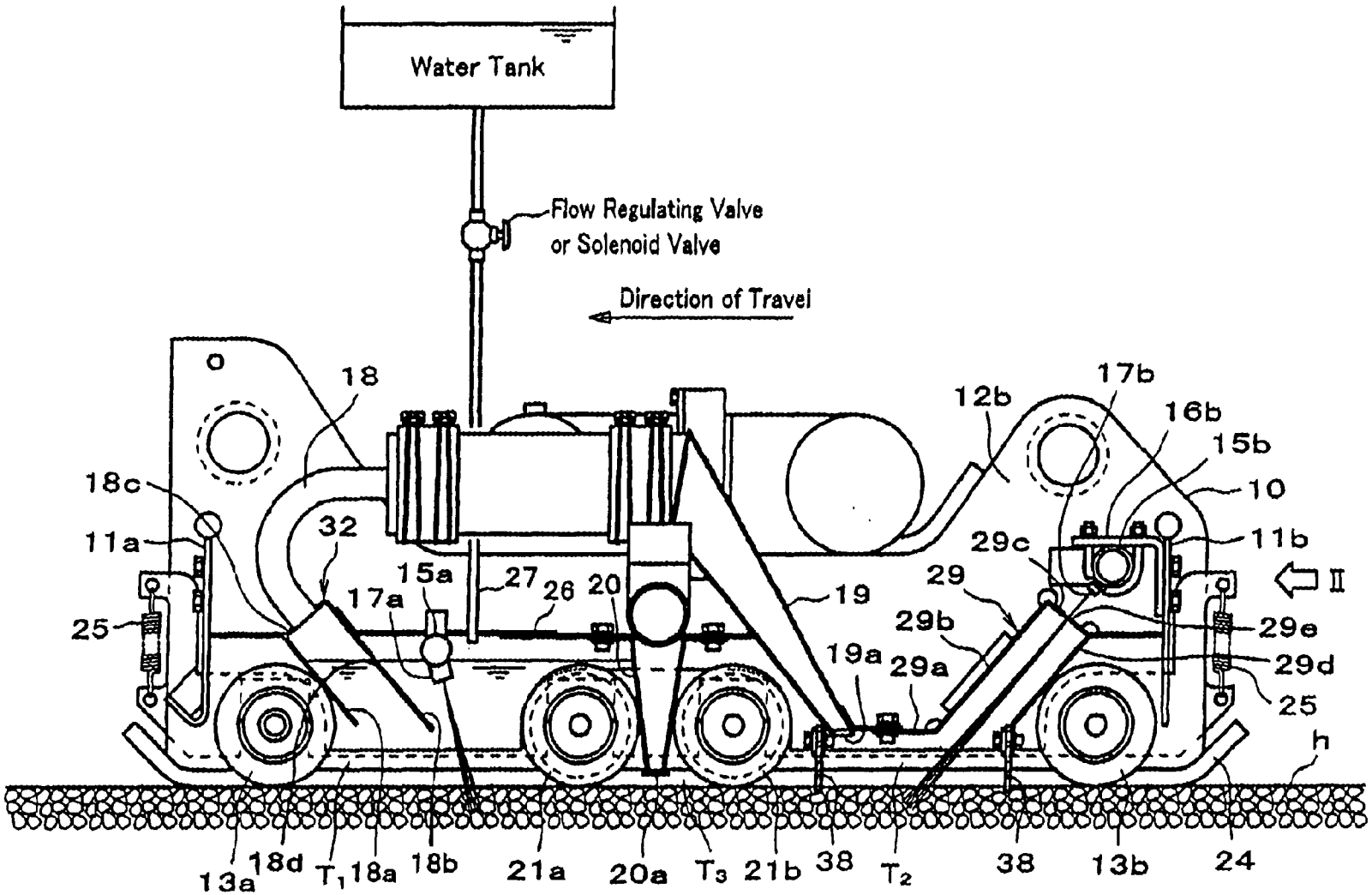
FIG. 1 is an illustrative section for describing an apparatus for processing a pavement surface in an embodiment of the first aspect of the present invention.
Figure 2:
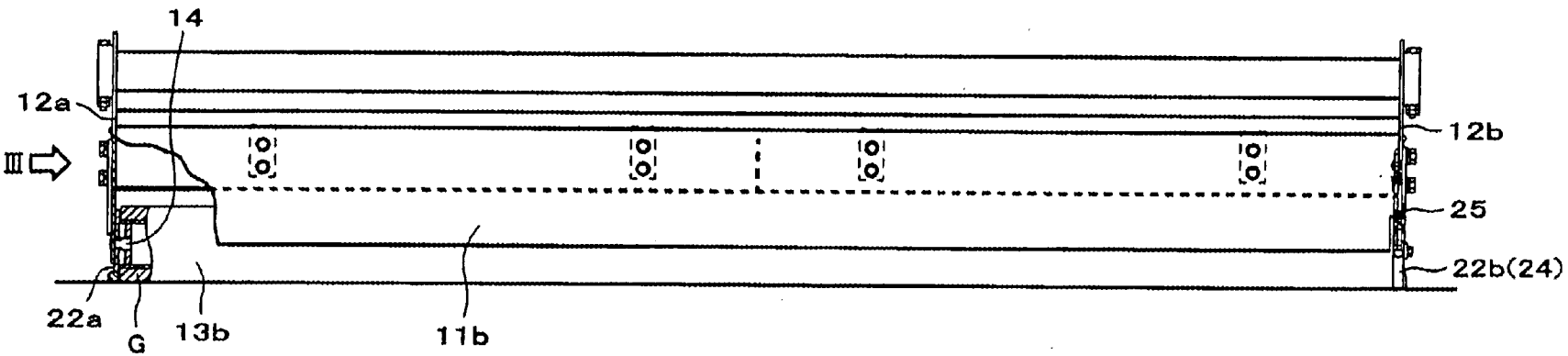
FIG. 2 is a partially cutaway view of a view looked in the arrow II of FIG. 1.
Figure 3:
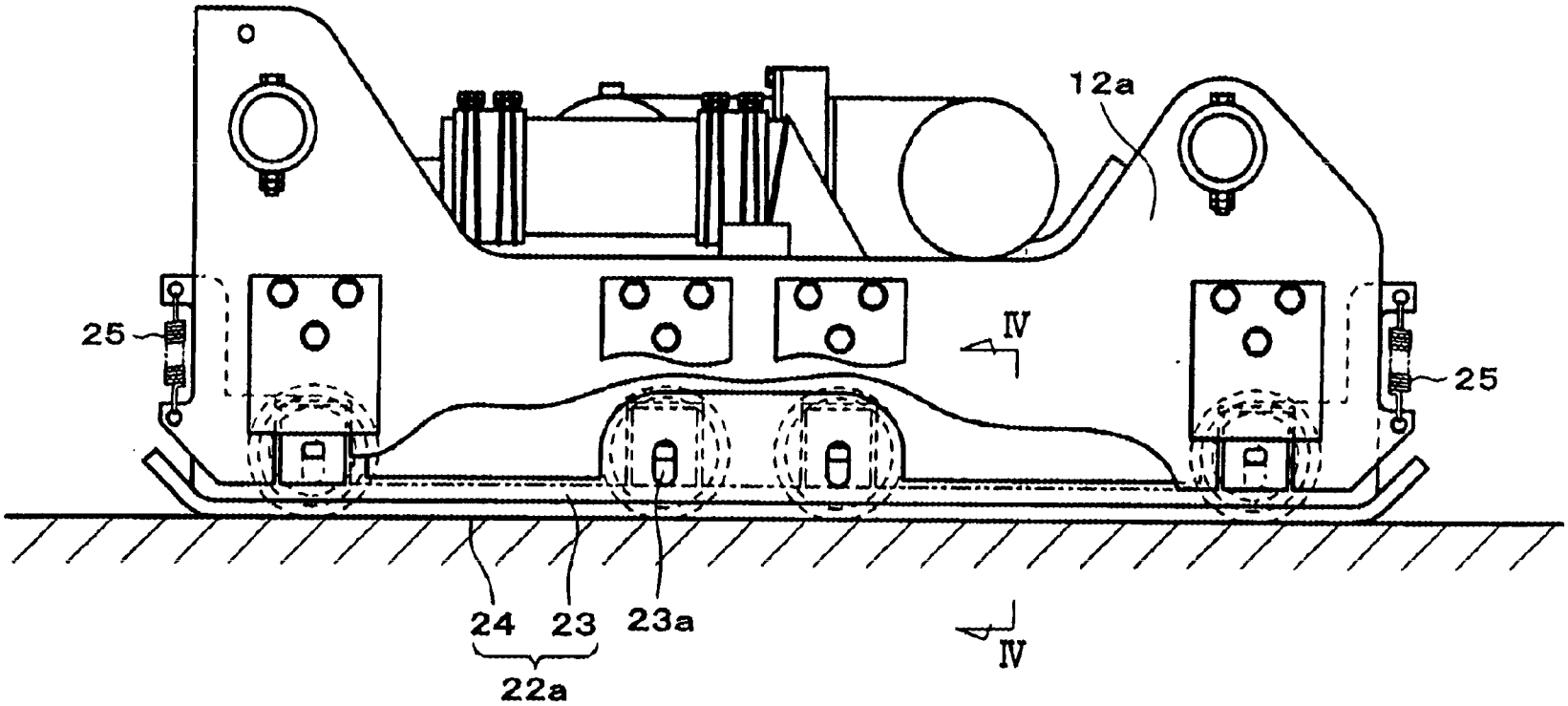
FIG. 3 is a partially cutaway view of a view looked in the arrow III of FIG. 2.
Figure 4:
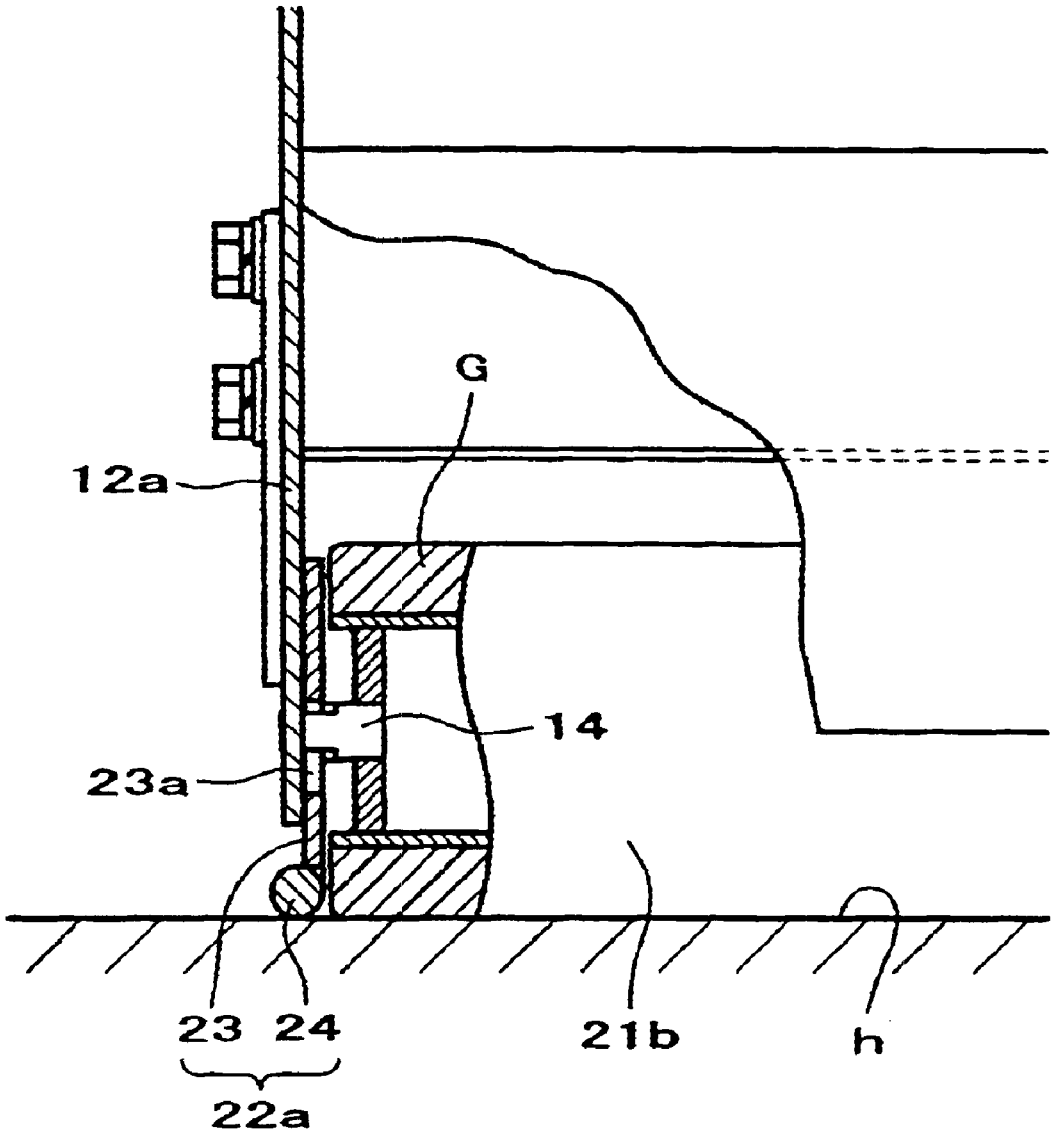
FIG. 4 is a partially cutaway view of a section in a line IV—IV.
Figure 5:
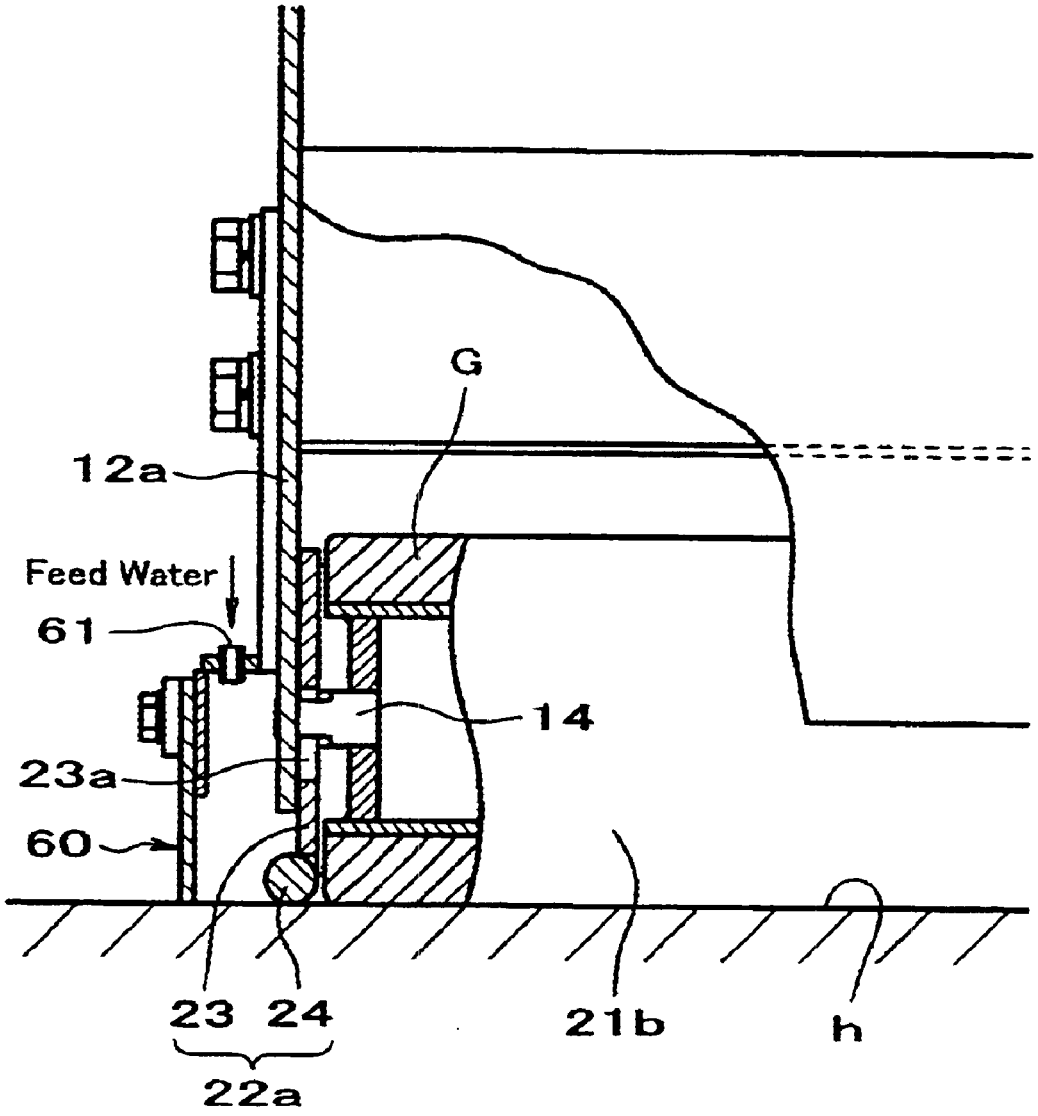
FIG. 5 is a partially cutaway view for describing an example of a water lying means.

In one specific example, the water lying shown in FIG. 5 operates as follows. A box element 60 is attached to a part of the left-and-right end plates 12*a* and 12*b* from outside, which corresponds to the position of the suction duct 20. The upper plate of the box element 60 has a water feed pipe 61 connected and the water feed pipe 61 feeds water into the box element 60 forcefully. Therefore, water intervenes between the round bar parts 24 of the side covers 22*a* and 22*b* and the pavement surface h. The lower edge of the box element 60 comes into contact with the pavement surface h.

Figure 6:
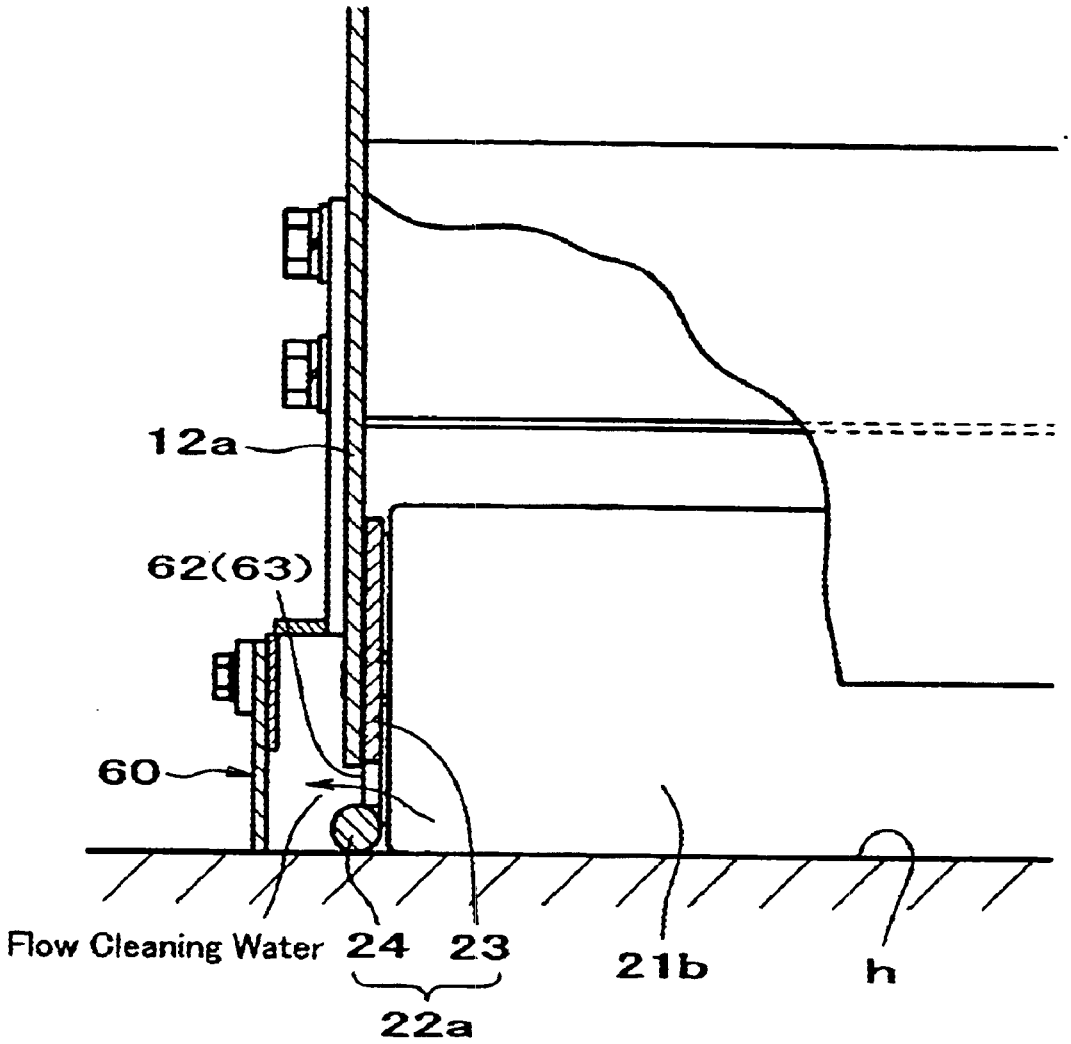
FIG. 6 is a partially cutaway view for describing another example of a water lying means.

The water intervening shown in FIG. 6 operates as follows. The box element 60 is attached to a part of the left-and-right end plates 12*a* and 12*b* from outside, which corresponds to the position of the suction duct 20. In addition, the side covers 22*a* and 22*b* have a guide hole 63 formed therein. The substantial sealed space $T_2$ communicates with the box element 60 through the guide hole 63. Therefore, water, which is sprayed from the injection nozzle 17*b* toward the pavement surface h, is guided into the box element 60 through the guide hole 63. The lower edge of the box element 60 comes into contact with the pavement surface h.

In the above-described embodiment, the top 26 has the water feed part 27 and the water feed part 27 feeds water into the liquid storage part $T_1$. In another way, the injection nozzle 17*a* injecting high pressurized water may feed water into the liquid storage part $T_1$ or both the water feed part 27 and the injection nozzle 17*a* may be used to feed water into the liquid storage part $T_1$. In either case, a feed amount of water is adjusted in accordance with suction power of the suction duct 18. As a consequence, the injection outlet of the injection nozzle 17*a* is always placed in water even if water in the liquid storage part $T_1$ is carried by suction from the suction duct 18.

The above-described embodiment describes the case in which the processing apparatus of the present invention applies to drainage pavement as an example. The present invention is not limited to this and the present invention may apply to removing a clogging object in the cavity in a permeable pavement, removing foreign matter in road surface grooving (ditch), or removing tire rubber in an airport runway.

Next, referring to FIGS. 7–9, an apparatus for processing a pavement surface in the embodiment of the second aspect of the present invention will now be described.

The apparatus for processing a pavement surface chips the surface course (aggregate coupled by asphalt) when soil, sand, and dust clog significantly and the surface course f of the drainage pavement a is paved with new material again. The apparatus has, for example, an outside case 110, which is attached to a towed vehicle such as a truck or the like via a movable arm.

Front and rear side plates 111*a* and 111*b* in the direction of travel of the vehicle and left-and-right end plates 112*a* and 112*b*, which couple both edges of the side plates 111*a* and 111*b*, form the outside case 110. Therefore, the outside case 110 is a long substantially rectangular parallelepiped and the length thereof is in the width direction of the vehicle. The top and the bottom of the outside case 110 are open. The left-and-right end plates 112*a* and 112*b* have both ends roll axes 114 of traveling rolls 113*a* and 113*b* supported. The traveling rolls 113*a* and 113*b* are placed in the fore-and-aft direction of travel of the vehicle. Each outer periphery of the traveling rolls 113*a* and 113*b* has an elastic body G made of rubber or the like covered, respectively.

The outside case 110 has an inside case 200 placed therein. The inside case 200 has a front side plate 201*a*, a rear side plate 201*b* and a top 202. The front side plate 201*a* is placed forward of the front side traveling roll 113*a* with a clearance C between the front side plate 201*a* and the front side traveling roll 113*a*. The rear side plate 201*b* is placed back of the rear side traveling roll 113*b* with a reclaim space P between the rear side plate 201*b* and the rear side traveling roll 113*b*. The top 202 couples the upper edges of front and rear side plates 201*a* and 201*b* together. The bottom of the inside case 200 is open. The front and rear side plates 201*a* and 201*b* and the top 202 extend in the width direction of the vehicle and both edges thereof are fixed to the end plates 112*a* and 112*b* of the outside case 110.

A water passing tube 115*a* is extended in the width direction of the vehicle upward between the front side traveling roll 113*a* and the rear side traveling roll 113*b* in the inside case 200. A water passing tube 115*b* is extended in the width direction of the vehicle between the rear side plate 201*b* of the inside case 200 and the side plate 111*b* of the outside case 110.

A water feed tube 203 passing through the top 202 is connected to the upper side part of the water passing tube 115*a*. The lower side part of the water passing tube 115*a* has an injection nozzle (injection means) 117*a*, which injects high pressurized water toward a pavement surface h, provided in the axial direction of the water passing tube 115*a* at substantially regular intervals. The injection nozzle 117*a* is extended in a slanting position to the rear side of the direction of travel of the vehicle, and sprays high pressurized water toward the pavement surface h placed forward of the rear side traveling roll 113*b*. An injection outlet H provided at the tip of the injection nozzle 117*a* is placed back of the upper surface of the rear side traveling roll 113*b*.

A water feed tube 204 is connected to the upper side part of the water passing tube 115*b*. The lower side part of the water passing tube 115*b* has an injection nozzle 117*b*, which injects high pressurized water toward a pavement surface h in a slanting front direction, provided in the axial direction of the water passing tube 115*b* at substantially regular intervals. The position, in which the injection nozzle 117*b* sprays toward the pavement surface h, is slightly back of the reclaim space P.

Figure 7:
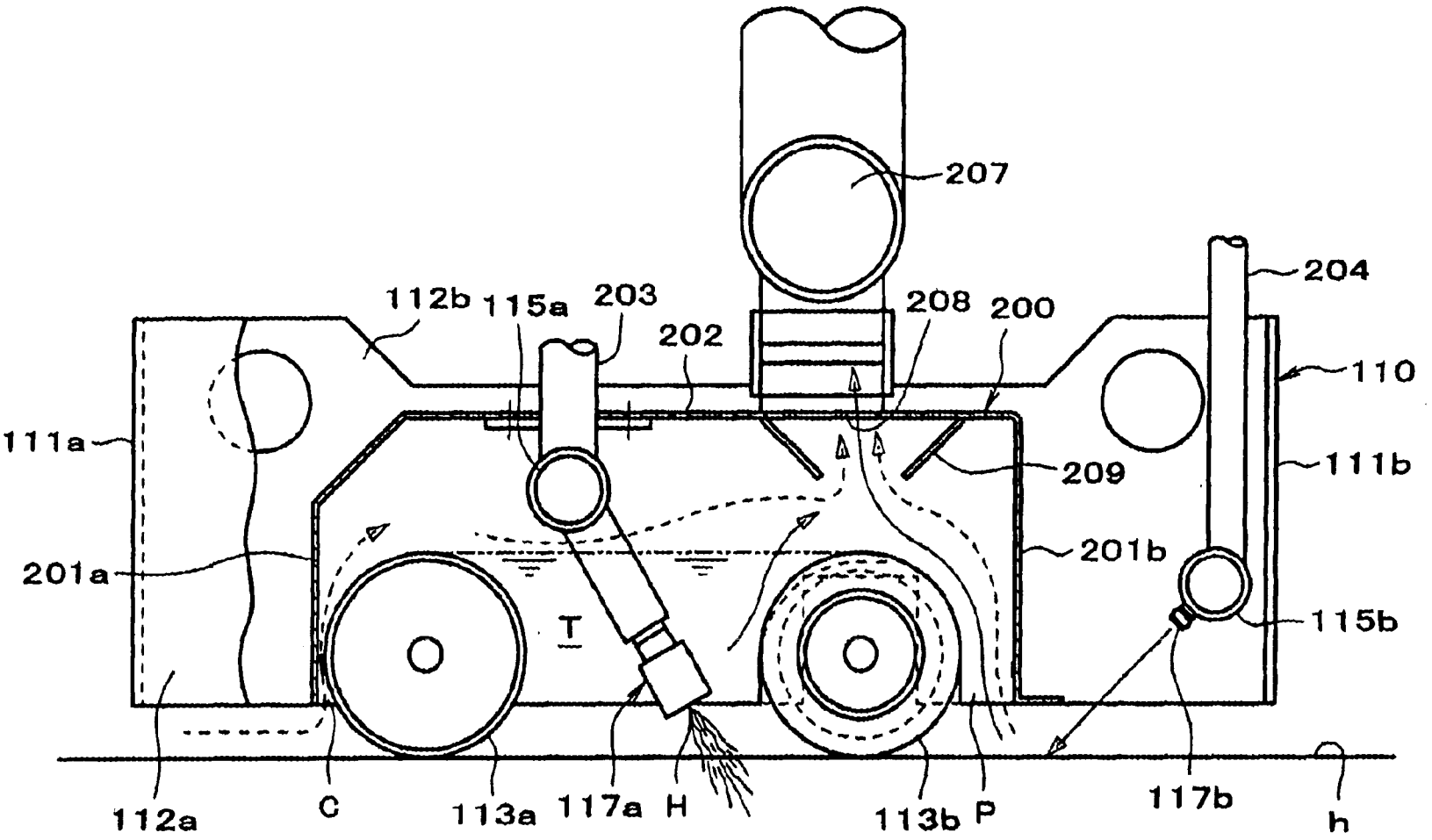
FIG. 7 is an illustrative section for describing an apparatus for processing a pavement surface in an embodiment of the second aspect of the present invention.
Figure 8:
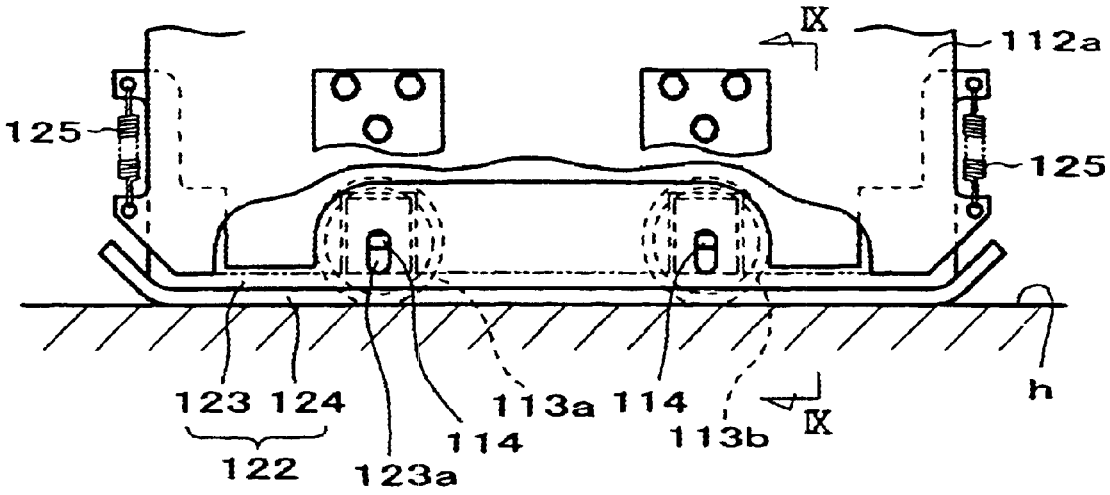
FIG. 8 is a partially cutaway view for describing a seal structure on both sides of a case.
Figure 9:
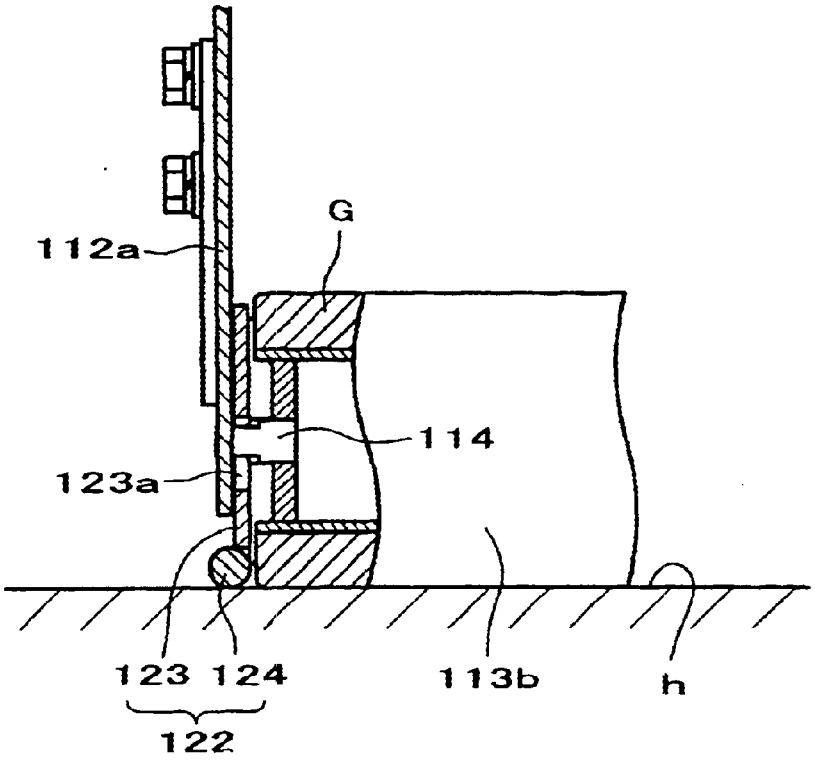
FIG. 9 is a section in a line IX—IX.

As shown in FIGS. 8 and 9, a side cover 122 is placed between each roll end face of one of the traveling rolls 113*a* and 113*b* and the end plate 112*a* of the outside case 110, and between each roll end face of the other of the traveling rolls 113*a* and 113*b* and the end plate 112*b* of the outside case 110, respectively. (With reference to FIG. 7, the side cover 122 is not shown.)

The side cover 122 has a plate body part 123 and a round bar part 124. The round bar part 124 is fixed to the lower part of the body part 123 in the direction of travel by welding or the like and comes into contact with the pavement surface h.

A long hole 123*a* extending vertically is formed at the position of the body part 123 corresponding to the both ends roll axes 114 of the traveling rolls 113*a* and 113*b*. The long hole 123*a* has the both ends roll axes 114 of the traveling rolls 113*a* and 113*b* inserted. Therefore, the side cover 122 can move vertically, and when traveling on the uneven pavement surface h, the round bar part 124 follows the uneven pavement surface h.

There is a helical tension spring 125 between one of the side covers 122 and the end plate 112*a*. The upper edge of the helical tension spring 125 is attached to the body part 123 of the side cover 122 and the lower edge of the helical tension spring 125 is attached to the end plate 112*a*.

Similarly, there is a helical tension spring 125 between the other of the side cover 122 and the end plate 112*b*. The upper edge of the helical tension spring 125 is attached to the body part 123 of the side cover 122 and the lower edge of the helical tension spring 125 is attached to the end plate 112*b*.

Therefore, each side cover 122 is urged toward the pavement surface h to bring the round bar part 124 into further intimate contact with the pavement surface h. The spring constant of the helical tension spring 125 is adjusted and the contact pressure of the round bar part 124 to the pavement surface h can be adjusted.

In the present embodiment, the traveling rolls 113*a* and 113*b*, the end plates 112*a* and 112*b* of the outside case 110, and the side cover 122 form a liquid storage part T allowing to store water in the inside case 200. Through the injection of high pressurized water by the injection nozzle 117*a*, water is fed to the liquid storage part T.

Therefore, the injection outlet H of the injection nozzle 117*a* is placed in water. In this state, the injection outlet H of the injection nozzle 117*a* injects high pressurized water toward the pavement surface h. As a consequence, cavitation is produced between water in the liquid storage part T and high pressurized water, and the surface course f of the drainage pavement a is removed by impactive force of the cavitation.

The surface course material (separated object) after chipping is placed in the liquid storage part T. The surface course material is reclaimed by suction from a suction opening 208 of a suction duct 207 (suction means) with water in the liquid storage part T and a clogging object such as earth, sand, dust and the like clogging the cavity e of the surface course f. The suction opening 208 is connected at the top 202 above the rear side traveling roll 113*b*. The surface course material, which cannot be reclaimed, is collected under the reclaim space P by spray pressure of high pressurized water injected by the injection nozzle 117*b* with water and the clogging object, and reclaimed by suction via the reclaim space P from the suction opening 208.

The suction opening 208 of the suction duct 207 is extended in the width direction of the vehicle and open to the inside case 200. A suction nozzle 209 is provided under the suction opening 208. An amount of injection water from the injection outlet H of the injection nozzle 117*a* is adjusted in accordance with suction power of the suction duct 207. As a consequence, the injection outlet H of the injection nozzle 117*a* is always placed in water even if water in the liquid storage part T is reclaimed by suction from the suction opening 208.

The flows of water and air reclaimed by suction from the suction opening 208 are shown in FIG. 7. In FIG. 7, dashed lines indicate the flow of air and solid lines indicate the flow of water. Air is reclaimed by suction through the clearance C and the reclaim space P, and water is reclaimed by suction from the liquid storage part T and reclaimed by suction through the reclaim space P. In the present embodiment, the water lying means described in the embodiment of the first aspect is not provided.

Operation of the apparatus for processing a pavement surface, which has the above-described configuration, will now be described. First, a suction apparatus (not shown) is driven to give suction to the suction duct 207. Suction of air in the inside case 200 produces negative pressure to some extent in the inside case 200. In this state, high pressurized water is fed to the water passing tubes 115*a* and 115*b* via the water feed tubes 203 and 204, and the injection nozzles 117*a* and 117*b* inject high pressurized water toward a pavement surface h. While water is stored in the liquid storage part T and the injection outlet H of the injection nozzle 117*a* is placed in water, the vehicle drives frontward on the road of the drainage pavement a.

At this time, cavitation is produced between water in the liquid storage part T and high pressurized water injected from the injection outlet H of the injection nozzle 117*a* toward the pavement surface h. Coupling part between aggregate and asphalt in the surface course f of the pavement a are broken by impactive force of the cavitation, and the surface course f is chipped without aggregate cracks.

The surface course material after chipping is placed in the liquid storage part T. The surface course material is reclaimed by suction from a suction opening 208 of a suction duct 207 with water in the liquid storage part T and a clogging object such as earth, sand, dust and the like clogging the cavity e of the surface course f. The surface course material, which cannot be reclaimed, is collected under the reclaim space P by spray pressure of high pressurized water injected by the injection nozzle 117*b* with water and the clogging object, and reclaimed by suction via the reclaim space P from the suction opening 208.

As is clear from the description above, in the present embodiment, cavitation is produced between water in the liquid storage part T and high pressurized water injected from the injection outlet H of the injection nozzle 117*a*. The surface course f is chipped by impactive force of the cavitation and a separated object after chipping is removed by suction with water. Therefore, aggregate, pebble, and the like can be prevented from flying to ensure safety, moreover, noise at chipping can be reduced.

Further, the surface course f can be chipped without aggregate cracks, therefore, a surface course after chipping can be recycled.

Moreover, the side covers 122 seal edges of the case 110 in the direction of the length of the case 110, and they are placed to be able to move vertically. At traveling on the uneven pavement surface h, the round bar part 124 follows the uneven spot. Further, the helical tension spring 125 applies a force to the side covers 122 toward the pavement surface h to bring the round bar part 124 into further intimate contact with the pavement surface h. Therefore, leaks of water in the liquid storage part T between the round bar part 124 and the pavement surface h to the outside can be controlled.

In the above-described embodiment, the injection nozzle 117*a* injecting high pressurized water feeds water into the liquid storage part T. In another way, the top 202 of the inside case 200 has a water feed part (not shown) and the water feed part may feed water into the liquid storage part T or both the water feed part and the injection nozzle 117*a* may be used to feed water into the liquid storage part T. In either case, a feed amount of water is adjusted in accordance with suction power of the suction duct 207. As a consequence, the injection outlet H of the injection nozzle 117*a* is always placed in water even if water in the liquid storage part T is carried by suction from the suction duct 207.

The above-described embodiment takes the case in which the processing apparatus of the present invention applies to a drainage pavement as an example. The present invention is not limited to this and the present invention may apply to permeable pavement.

In addition, the above-described embodiment describes the apparatus chipping the surface course (aggregate coupled by asphalt) when soil, sand, and dust clog significantly and the surface course f of the drainage pavement a is paved with new material again as an example. There is no need to limit the present invention to this. The present invention may apply to an apparatus of the same configuration. The apparatus chips the surface of the pavement a (only the upper layer of the surface course f) by adjusting an amount of injection and/or injection pressure of the injection nozzle 117*a* at chipping a road surface for increasing thickness of the concrete road surface of such as a bridge, and removing tire rubber and the like adhered to a road surface of an airport runway.

The lime wash (peeled object) produced by chipping is placed in the liquid storage part T. The lime wash is reclaimed by suction from the suction opening 208 of the suction duct 207 with water in the liquid storage part T. The lime wash, which cannot be reclaimed, is collected under the reclaim space P by spray pressure of high pressurized water injected by the injection nozzle 117*b*, and reclaimed by suction via the reclaim space P from the suction opening 208.

According to the first aspect of the present invention having a configuration described above, pressurized water is injected from an injection outlet of an injection means toward the pavement surface in liquid of a liquid storage part formed on the pavement surface and cavitation is produced. A clogging object in the cavity of a pavement is isolated by impactive force of the cavitation, and the isolated clogging object is removed by suction with water. Therefore, as compared with case in which pressurized water is just injected toward the pavement surface in air, the effect of removing a clogging object in the pavement can by far be improved.

In this case, atmospheric pressure in the liquid storage part is lower than atmospheric pressure of the outside. Therefore, water in the liquid storage part can be resistant to leaks to the outside, and production of cavitation at injecting high pressurized water in water is furthered.

In the second aspect of the present invention, cavitation is produced between water in the liquid storage part T and pressurized water injected from an injection outlet of an injection means. A surface course is chipped by impactive force of the cavitation and a separated object after chipping is removed by suction with water. Therefore, aggregate, pebble, and the like can be prevented from flying to ensure safety, moreover, noise at chipping can be reduced.

Further, the surface course can be chipped without aggregate cracks, therefore, a surface course after chipping can be recycled.

What is claimed is:

1. An apparatus for processing a pavement surface comprising:

an injection means for injecting pressurized water toward the pavement surface;

a liquid storage part surrounding an injection outlet of said injection means and allowing liquid to be stored, wherein said liquid storage part contacts the pavement surface in such a manner that the injection outlet is positioned in the liquid stored therein; and a suction means for removing a clogging object through a suction opening positioned downward with respect to said injection outlet, wherein the clogging object is isolated from a cavity of the pavement surface by cavitation erosion caused by the injection of pressurized water from said injection means.

2. The apparatus for processing a pavement surface as claimed in claim 1, wherein a pressure in said liquid storage part is lower than a pressure outside of said liquid storage part.

3. An apparatus for processing a pavement surface according to claim 1, wherein said suction means is a suction duct disposed rearward of said liquid storage part and which suctions the clogging object isolated from said cavity of said pavement surface by the cavitation erosion, and wherein said clogging object is suctioned through a suction opening of said suction duct, the suction opening being positioned at the vicinity of said pavement surface.

4. An apparatus for processing a pavement surface according to claim 1, wherein said suction means is a suction duct which removes air from said liquid storage part through a hole formed thereon, and also suctions the clogging object isolated from said cavity of said pavement surface by the cavitation erosion, wherein the clogging object is suspended in the liquid stored in said liquid storage part, and wherein an end part of said suction duct is positioned in the liquid stored in said liquid storage part.

5. An apparatus for processing a pavement surface according to claim 1, wherein said suction means comprises:

a first suction duct disposed rearward of said liquid storage part and which removes the clogging object isolated from said cavity of said pavement surface by the cavitation erosion; and a second suction duct which removes air from said liquid storage part and suctions the clogging object isolated from said cavity of said pavement surface by the cavitation erosion, wherein the clogging object is suspended in the liquid stored in said liquid storage part.

6. An apparatus for processing a pavement surface according to claim 5, further comprising:

a second injection means disposed at the rear side of said second suction duct and which injects pressurized water towards the pavement surface at a predetermined incident angle with respect to said pavement surface; and a third suction duct which suctions a clogging object removed from said pavement surface by the pressurized water injected from said second injection means.

7. An apparatus for processing a pavement surface comprising:

an injection means for injecting pressurized water toward the pavement surface at a predetermined inclined angle and for chipping the pavement surface;

a liquid storage part surrounding an injection outlet of said injection means and allowing liquid to be stored, wherein said liquid storage part contacts the pavement surface in such a manner that the injection outlet is positioned in the liquid stored therein; and a suction means for removing a separated object by suction after the pavement surface has been chipped by cavitation erosion caused by the injection of pressurized water from said injection means, wherein said separated object is guided to said suction means by the pressure of said pressurized water.

8. An apparatus for processing a pavement surface according to claim 7, further comprising:

a second injection means which injects pressurized water toward said separated object on said pavement surface and guides said separated object to said suction means.

9. An apparatus for processing a pavement surface comprising:

an injection device which injects pressurized water toward the pavement surface;

a liquid storage part which surrounds an injection outlet of said injection device and allows liquid to be stored, wherein the liquid storage part contacts the pavement surface in such a manner that the injection outlet is positioned in the liquid;

a first suction device which suctions a clogging object through a suction opening positioned downward with respect to said injection outlet, wherein said clogging object is isolated from a cavity of the pavement surface by cavitation erosion caused by the injection of pressurized water from said injection device.

10. An apparatus for processing a pavement surface according to claim 9, wherein said suction device is a suction duct disposed rearward of said liquid storage part and which suctions the clogging object isolated from a cavity of said pavement surface by the cavitation erosion, and wherein said clogging object is suctioned through a suction opening of said suction duct, the suction opening being positioned at the vicinity of said pavement surface.

11. An apparatus for processing a pavement surface according to claim 9, wherein said suction device is a suction duct which removes air from said liquid storage part through a hole formed thereon, and also suctions the clogging object isolated from said cavity of said pavement surface by the cavitation erosion, wherein the clogging object is suspended in the liquid stored in said liquid storage part, and wherein an end part of said suction duct is positioned in the liquid stored in said liquid storage part.

12. An apparatus for processing a pavement surface according to claim 9, wherein said suction device comprises:

a first suction duct disposed rearward of said liquid storage part and which removes the clogging object isolated from a cavity of said pavement surface by the cavitation erosion; and a second suction duct which removes air from said liquid storage part and suctions the clogging object isolated from said cavity of said pavement surface by the cavitation erosion, wherein the clogging object is suspended in the liquid stored in said liquid storage part.

13. An apparatus for processing a pavement surface comprising:

an injection device which injects pressurized water toward the pavement surface at a predetermined inclined angle, thereby chipping the pavement surface;

a liquid storage device surrounding an injection outlet of said injection device and allowing liquid to be stored, wherein said liquid storage device contacts the pavement surface in such a manner that the injection outlet is positioned in the liquid stored therein; and a suction device which removes a separated object by suction after the pavement surface has been chipped by cavitation erosion caused by the injection of the pressurized water from said injection device, wherein said separated object is guided to said suction device by the pressure of said pressurized water.

14. An apparatus for processing a pavement surface according to claim 13, further comprising:

a second injection device which injects the pressurized water toward said separated object on said pavement surface and guides said separated object to said suction device.

* * * * *